United States Patent [19]

Grow et al.

[11] 4,177,717

[45] Dec. 11, 1979

[54] BAFFLE SYSTEM FOR FUME HOOD

[75] Inventors: Harry N. Grow, Two Rivers; Jon A. Zboralski, Manitowoc, both of Wis.

[73] Assignee: American Hospital Supply Corporation, Evanston, Ill.

[21] Appl. No.: 928,462

[22] Filed: Jul. 27, 1978

[51] Int. Cl.[2] ..... F23J 11/00

[52] U.S. Cl. ..... 98/115 LH; 55/DIG. 15; 422/104

[58] Field of Search ..... 98/115 LH, 115 R; 422/104; 55/DIG. 15

[56] References Cited

U.S. PATENT DOCUMENTS

| | | | |
|---|---|---|---|
| 2,627,220 | 2/1953 | Morrow | 98/115 LH |
| 2,704,505 | 3/1955 | Morrison | 98/115 LH |
| 3,217,630 | 11/1965 | Katzfey et al. | 98/115 LH |
| 3,218,953 | 11/1965 | Grow et al. | 98/115 LH |
| 3,747,504 | 7/1973 | Turko et al. | 98/115 LH |

*Primary Examiner*—Ronald C. Capossela
*Attorney, Agent, or Firm*—Larry N. Barger

[57] ABSTRACT

A laboratory fume hood that has a lower baffle, intermediate baffle, and upper baffle spaced from each other and from a floor of the fume hood for directing fumes upwardly to an exhaust opening. The baffle system provides an inverted funnel configuration with the hood wall for improved gas sweeping action adjacent the hood floor.

20 Claims, 3 Drawing Figures

BAFFLE SYSTEM FOR FUME HOOD

BACKGROUND

U.S. Pat. Nos. 3,218,953 and 3,747,504 describe laboratory fume hoods with a rear particle wall and adjustable baffle adjacent this wall for directing gases from various locations in the fume hood to an upper exhaust port. The baffles described in these patents include an upper baffle with an obtuse angular bend at it center and a lower flat panel baffle. The upper panel is pivotally mounted to the rear wall at an apex of its obtuse angle, and the lower flat panel baffle is pivoted at its bottom end. By pivotally adjusting the two panel baffle system described in these patents, the fume hood can accomodate different weight fumes, i.e. gases. Three separate settings of these baffles handle fumes that are (1) approximately equivalent to air weight, (2) heavier than air, and (3) lighter than air. A schematic illustration of the various settings of the baffles of the above two patents is submitted with the prior art material for background.

U.S. Pat. No. 3,217,630 describes a single panel baffle of obtuse angular design for use with counter top fume hoods. U.S. Pat. No. 2,627,220 illustrates in FIG. 4 a two panel vent spaced immediately above a triangularly shaped deflector. The bottom edge of such deflector is joined to a rear wall of the fume hood and has merely to deflect gas away from the rear wall rather than toward the rear wall.

All of the above two panel baffle systems have a vent above which is mounted a fan that forces the fumes through a conduit to an area outside the building. In a walk-in-hood, the exhaust vent might be 7 feet or more above the floor. The problem is less critical in a counter top fume hood where the vertical rear wall gas suction passage is approximately 3–4 feet in length. However, even in a counter top hood there is some loss of gas sweeping action because of the length of this vertical suction passage. It is important to sweep a very large volume of fumes from all areas of the hood with as small a blower as possible. The reason for this is that extremely large blowers in the exhaust would generate such a tremendous air velocity in the fume hood that experiments within the hood could be hampered. In addition, as the blower size increases, the noise of the motor to power it generally increases.

SUMMARY OF THE INVENTION

The present invention overcomes the problem of the prior two panel baffle systems in poor gas flow volumes adjacent the fume hood floor because of the length of vertical draw along the fume hood's rear wall. This invention provides a three panel baffle system with a lower baffle, an intermediate baffle, and an upper baffle spaced apart from each other for gas flow between these baffles, and the lower baffle has a bottom edge around which is a bottom inlet to a draw or chimney passage adjacent the hood's rear walls. Preferably, the lower baffle or the combined lower and intermediate baffle are arranged relative to the rear wall to form an inverted funnel configuration with this rear wall. The separated three panel baffle system provides a more uniform and controllable flow of gases from various portions of the fume hood, with a substantially greater gas sweeping action adjacent the fume hood's floor while using the same gas blowers as previously used with two panel baffle systems.

THE DRAWINGS

DETAILED DESCRIPTION

Figure 1:
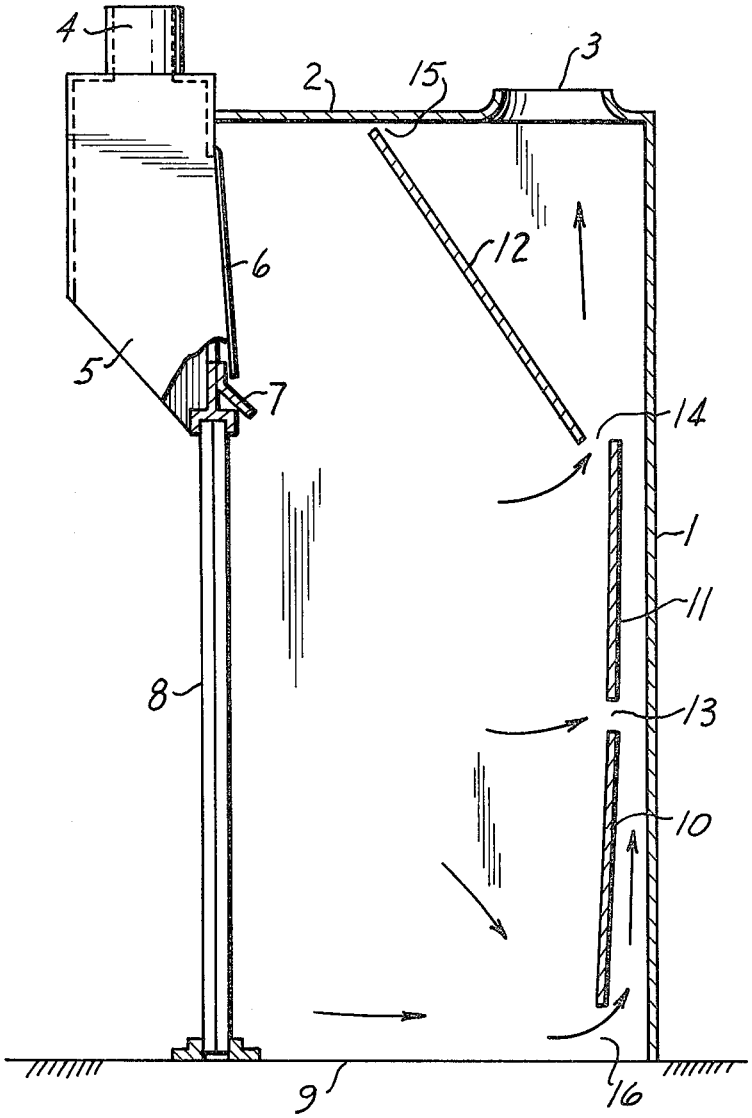
FIG. 1 shows a sectional view of an interior of a walk-in fume hood showing the relationship of the three baffles.

In FIG. 1, a fume hood includes a housing with a rear wall 1 joined to a top wall 2 that has an exhaust port 3. This exhaust port 3 would be connected to exhaust duct work with an exhaust blower which would pull gases out of the fume hood and force them along the duct work to an outside of the building. Since the blower and duct work are conventional, they do not form part of this invention, and have not been shown.

An inlet port 4 can be connected to duct work from outside the building to draw in outside air so undue amounts of heated room air are not sucked out through the fume hood to the exhaust duct work. This inlet port 4 is connected to a housing 5 which extends along a forward portion of the hood and distributes the inlet air. This inlet air can exit through a series of pivotal flaps shown schematically at 6. A deflector 7 can direct incoming air to an interior portion of the fume hood. Horizontally sliding doors 8 can open and close a front walk-in area of the hood. In FIG. 1, these doors can be considered to be in open position so the fume hood can draw in air from both the room and housing 5 with periodic flexures of flap 6.

In the walk-in fume hood of FIG. 1, blower 9 could be the floor of the room in which the fume hood was installed. Alternately, this floor could be a counter top upon which a shorter fume hood of 3–4 feet height were mounted.

The three panel baffle system includes a lower independently adjustable baffle 10, an intermediate independently adjustable baffle 11, and an independly adjustable upper baffle 12. These three baffles are spaced apart to provide gas inlets at 13, 14, 15, and 16 for collecting fumes from various heights in the fume hood. In the particular experiment conducted in the hood, different fumes could be given off, some which being lighter than air flow upwardly in the fume hood, and others being heavier than air flow downwardly. Thus, it is important to have a fume hood that is highly functional for the particular fumes in the hood. For very light fumes, upper baffle 12 would be tilted to provide a gap at 15 to collect such fumes.

In normal fume hood operation where fumes are composed of gases approximately the same weight as air, or where the fumes are substantially heavier than air, it is extremely important to have a very high volume sweeping action adjacent the floor of the fume hood. For this, a bottom inlet gap 16 is provided at a bottom end of lower baffle 10. This bottom end is preferably 1 to 3 inches above the floor 9. Preferably this vertical bottom gap is substantially greater than a horizontal pinch gap with the rear wall 1, such as at the upper end of baffle 10 or 11.

The bottom end of lower baffle 10 is spaced a greater distance from the rear wall 1 than is its upper end. The intermediate baffle 11 is shown with a lower end adjacent the lower baffle's upper end. The intermediate baffle 11 also upwardly converges toward the fume hood's back wall, as does the lower baffle. Thus, lower baffle 10 and intermediate baffle 11 combine to form with the back wall an inverted funnel configuration. If desired, such funnel configuration could be formed only with the lower panel.

Figure 2:
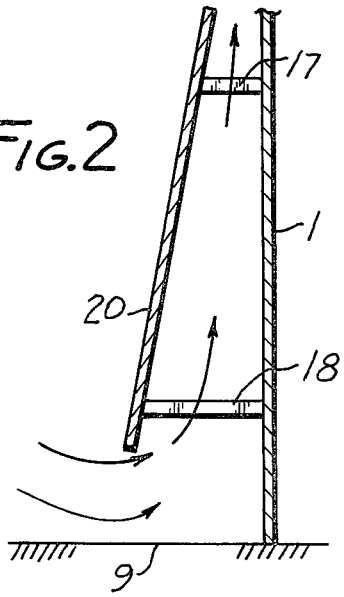
FIG. 2 is an enlarged view of the lower baffles region of the fume hood of FIG. 1 showing such lower baffle fixed to a rear wall of the fume hood.
Figure 3:
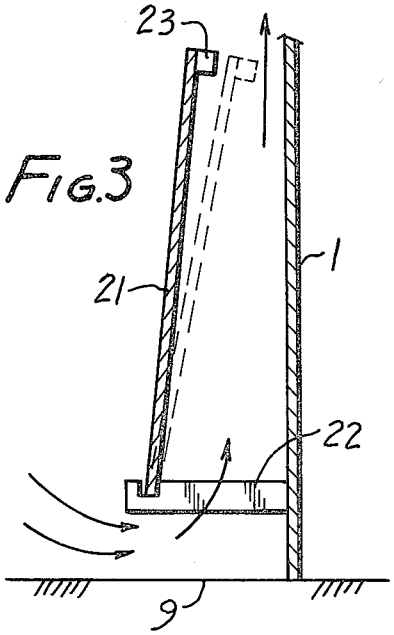
FIG. 3 is a view similar to FIG. 2, but showing an alternate pivoted lower baffle construction.

In FIG. 2, a lower panel 20 is shown fixedly secured to a back wall 1 of the panel by supports 17 and 18 which form insignificant obstruction to gas flow. In FIG. 3, a pivotal lower panel 21 is shown in an alternate version. Here a bottom end of lower panel 21 is pivotally mounted in a notch of a support 22 on a back wall 1 of a fume hood. One or more spacer lugs 23 can be provided at an upper end of lower baffle 21 to always insure a gas passage between lower baffle 21 and rear wall 1. For the improved sweeping action adjacent the floor, it is important the upper end of lower baffle 21 does not shut off against the rear wall 1.

The baffle system of this invention could be applied to either standard hoods or auxiliary hoods to control gas flow.

In the foregoing description, specific examples have been used to describe the invention. However, it is understood by those skilled in the art that certain modifications can be made to these examples without departing from the spirit and scope of the invention.

We claim:

1. A fume hood including a housing that has a wall with an adjacent baffle system for directing fumes to an exhaust wherein the improvement comprises: at least three baffles which include a lower baffle, an intermediate baffle, and an upper baffle spaced from each other for gas flow through openings between the three panels; and the lower baffle has a bottom edge spaced from the wall to provide a bottom gas inlet to the three baffle system.

2. A fume hood as set forth in claim 1, wherein the lower baffle's bottom edge is spaced further from the wall than a top edge of the intermediate baffle, so these two baffles form an inverted funnel configuration with the hood wall.

3. A fume hood as set forth in claim 2, wherein the lower baffle upwardly converges toward the hood wall.

4. A fume hood as set forth in claim 2, wherein the intermediate baffle upwardly converges toward the hood wall.

5. A fume hood as set forth in claim 2, wherein the lower baffle has an upper end and the intermediate baffle has a lower end, and these two ends are vertically separated from each other and are approximately equally spaced from the hood wall.

6. A fume hood as set forth in claim 1, wherein the lower baffle's bottom edge is spaced further from the wall than its top edge, so that the lower baffle forms an inverted funnel configuration with the hood.

7. A fume hood as set forth in claim 1, wherein the top baffle is adjustably movable independently of the other two baffles.

8. A fume hood as set forth in claim 1, wherein the intermediate baffle is adjustably movable independently of the other two baffles.

9. A fume hood as set forth in claim 1, wherein the lower panel is adjustably movable independently of the other two baffles.

10. A fume hood as set forth in claim 9, wherein the lower baffle and the hood wall have means insuring a gas flow passage therebetween at all operative adjustment settings of the lower baffle.

11. A fume hood as set forth in claim 10, wherein there is at least one spacer attached to the lower baffle.

12. A fume hood as set forth in claim 1, wherein the lower baffle is secured to the hood at a fixed distance from the wall.

13. A fume hood as set forth in claim 12, wherein the lower baffle is fixedly secured to the hood with its bottom edge a greater distance from the wall than its top edge.

14. A fume hood as set forth in claim 12, wherein the lower baffle is mounted directly on said hood wall.

15. A fume hood including a housing with a substantially vertical wall extending to a substantially horizontal floor and a baffle system for directing fumes along the vertical wall to an exhaust, wherein the improvement comprises: at least three baffles including a lower baffle, an intermediate baffle, and an upper baffle spaced from each other for gas flow through openings between the three panels; and there is a vertical bottom gap between the floor and a bottom edge of the lower baffle that is substantially greater than a horizontal pinch gap between a portion of the baffle system above the bottom gap and the vertical wall, whereby the fume hood has an improved gas sweeping action adjacent the floor.

16. A fume hood as set forth in claim 15, wherein the bottom end of the lower baffle is spaced from the vertical wall by a horizontal distance greater than the pinch gap.

17. A fume hood as set forth in claim 15, wherein the bottom gap is from 1 to 3 inches high.

18. A fume hood as set forth in claim 15, wherein the lower baffle is adjustable relative to the vertical wall.

19. A fume hood as set forth in claim 15, wherein the lower baffle is fixed relative to the rear wall.

20. A fume hood as set forth in claim 19, wherein the lower baffle converges upwardly toward the vertical wall.

* * * * *